US005772412A

United States Patent [19]

Zytynski

[11] Patent Number: 5,772,412

[45] Date of Patent: Jun. 30, 1998

[54] PUMP INCORPORATING PRESSURE-REGULATED VENTING MEANS

[75] Inventor: Zbigniew Janusz Zytynski, Forest Row, United Kingdom

[73] Assignee: Shurflo Limited, Crawley, United Kingdom

[21] Appl. No.: 666,551

[22] PCT Filed: Nov. 22, 1994

[86] PCT No.: PCT/GB94/02560

§ 371 Date: Aug. 14, 1996

§ 102(e) Date: Aug. 14, 1996

[87] PCT Pub. No.: WO95/17596

PCT Pub. Date: Jun. 29, 1995

[30] Foreign Application Priority Data

Dec. 22, 1993 [GB] United Kingdom ..... 9326153
Jan. 28, 1994 [GB] United Kingdom ..... 9401633

[51] Int. Cl.[6] ..... F04B 43/00; F04B 43/073

[52] U.S. Cl. ..... 417/393; 417/395; 92/220

[58] Field of Search ..... 417/393, 395; 92/220

[56] References Cited

U.S. PATENT DOCUMENTS 4,386,888 6/1983 Verley ..... 417/395 X
4,624,628 11/1986 Marchant ..... 417/393
4,708,827 11/1987 McMillin .

FOREIGN PATENT DOCUMENTS 0 172 367 6/1985 European Pat. Off. .
2 315 019 6/1975 France .
1085543 12/1964 United Kingdom .
2 062 774 11/1980 United Kingdom .
2 276 678 3/1994 United Kingdom .
WO 93/07389 4/1993 WIPO .

*Primary Examiner*—Timothy Thorpe
*Assistant Examiner*—Ted Kim
*Attorney, Agent, or Firm*—Gottlieb, Rackman & Reisman

[57] ABSTRACT

The invention provides a pump comprising at least one piston (26, 28) movable in a reciprocating manner within a chamber (12), sealing means (32*a*, 32*b*) located between the piston (26, 28) and the interior wall of the chamber (12), and venting means (36) for venting a portion of the chamber (12) bounded by the interior wall, the piston (26, 28) and the sealing means (32*a*, 32*b*), wherein the venting means (36) incorporates pressure regulating means (40) such that the pressure to which the said portion of the chamber (12) is vented can be regulated. This reduces the pressure differences across the or each sealing means and thus reduces deterioration and damage.

11 Claims, 3 Drawing Sheets

PUMP INCORPORATING PRESSURE-REGULATED VENTING MEANS

This application is a 371 of PCT/GB 94/02560 filed Nov. 22, 1994.

The invention relates to a pump particularly, but not exclusively, to a diaphragm pump suitable for pumping liquids.

Diaphragm pumps have been in use in industry for some years. In such pumps, piston are caused to move in a reciprocating manner within a chamber and sealing means are provided between the interior wall of the chamber and the moving piston. Sealed portions of the chamber are thereby created between the ends of the chamber and the relevant face of the appropriate piston. Any movement of the piston within the chamber therefore causes the pressure within that sealed portion of the chamber to change. Commonly, venting means are provided to allow the pressure within that portion of the chamber to return to ambient pressure at appropriate intervals during the operating cycle.

In certain instances, this venting can cause problems. For example, pumps of this type can be designed to transport liquids having internal pressures in the order of 18–28 psi created by internal carbonisation. Carbon dioxide or other gas or gas mixture supplied at a pressure of, for example, 60 psi, is introduced into the relevant portion of the chamber in order to move the appropriate piston from one operating position to another. When the reciprocal motion is to take place, the carbon dioxide or other gas at 60 psi is vented to atmosphere. This causes a pressure differential across the sealing means located between the piston and the interior wall of the chamber. Repeated pressure differences of this type can cause deterioration of the sealing means which must then be regularly inspected and, if necessary, replaced.

It is an object of the invention to provide a pump which does not have the aforementioned disadvantage and which therefore has an extended working life and reduced maintenance costs.

The invention provides a pump as set out in claim 1 of the appended claims. The invention also provides a pumping system as set out in claim 9 of the appended claims and a method of pumping a liquid as set out in claim 11 of the appended claims. Preferred features of the various aspects of the invention are set out in the subsidiary claims.

Embodiments of a pump according to the invention will now be described with reference to the accompanying drawings wherein.

Figure 1:
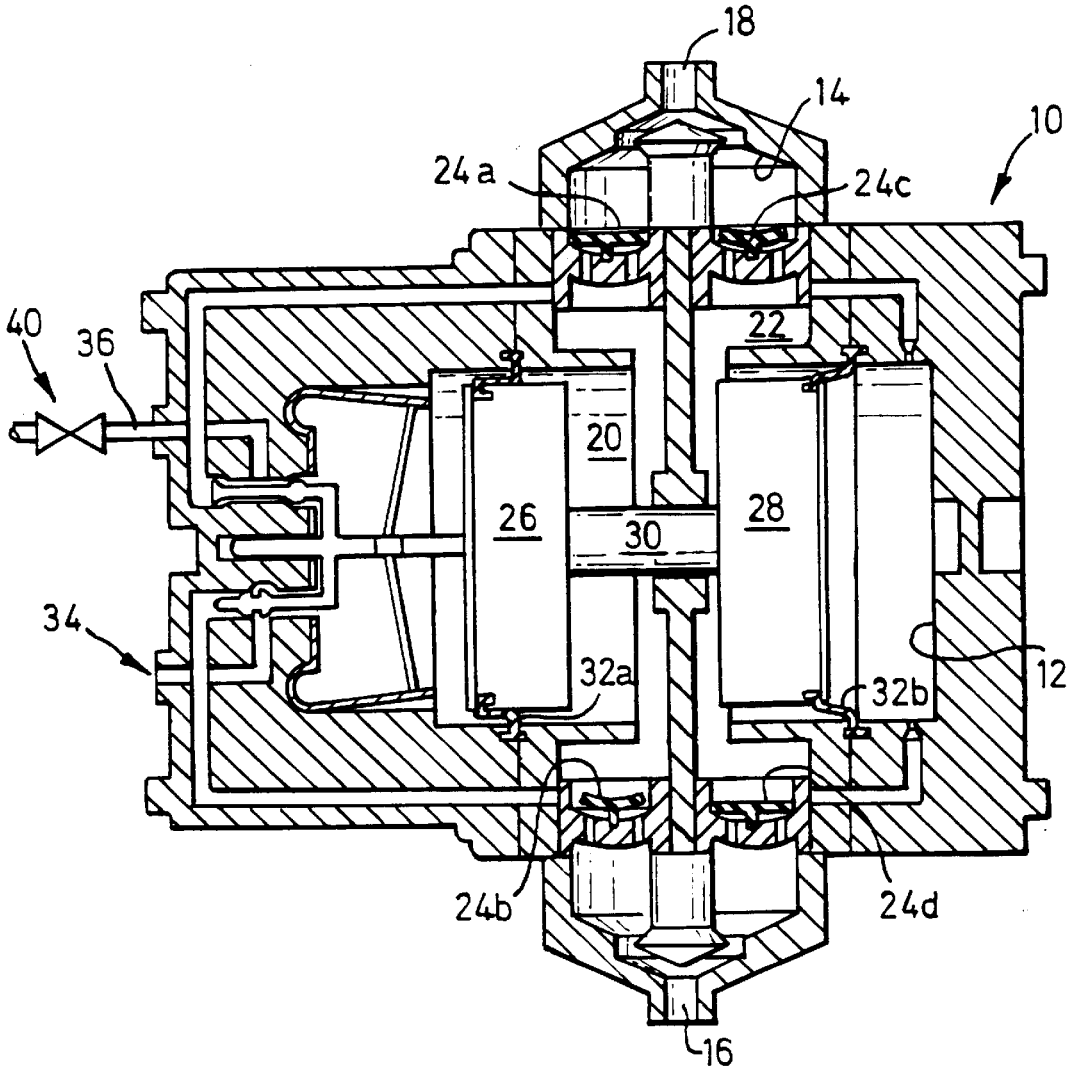
FIG. 1 is a schematic cross-section taken through the longitudinal axis of a pump according to a first embodiment of the invention in a first operation position.
Figure 2:
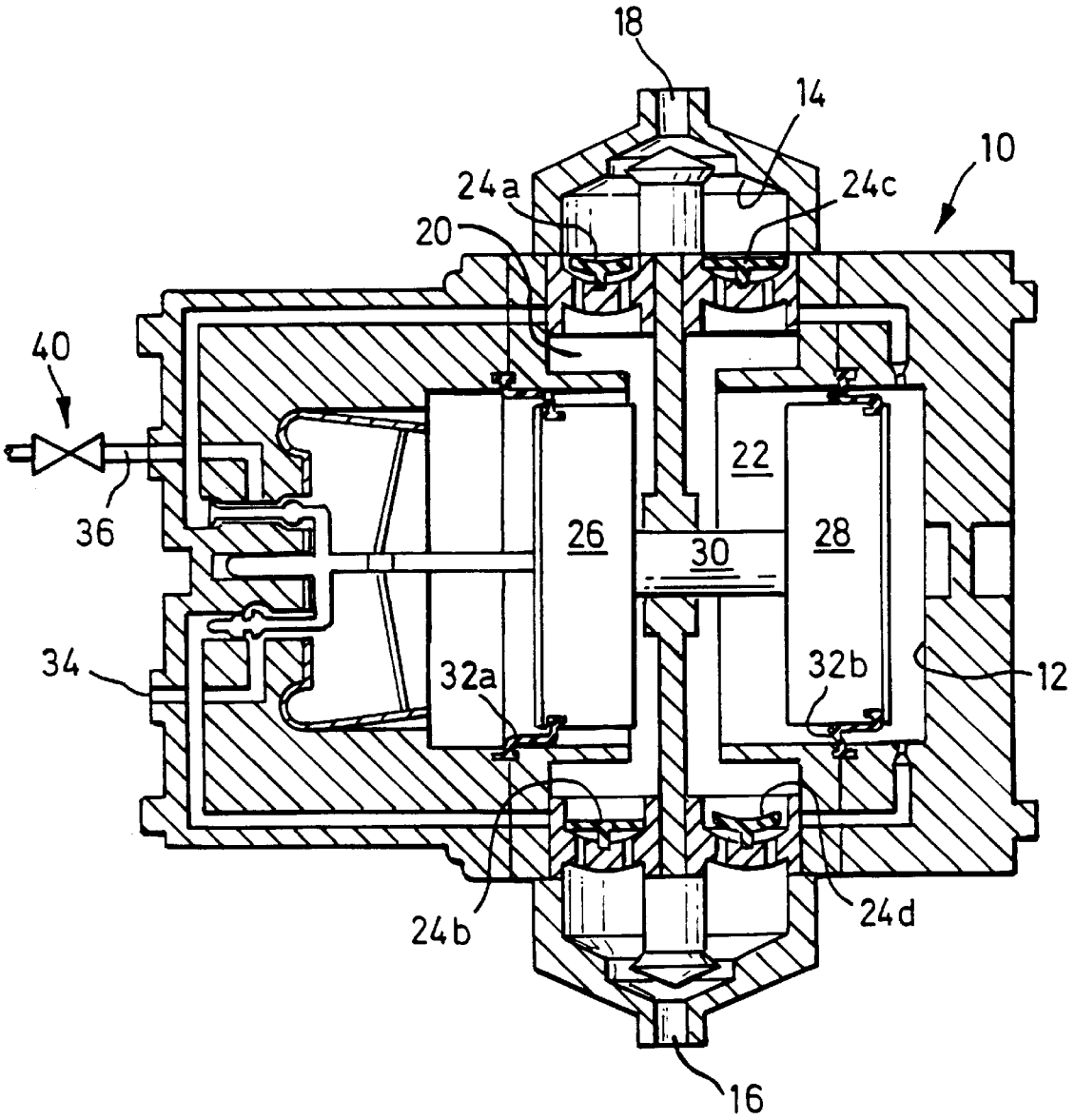
FIG. 2 is a schematic cross-sectional view of the pump of FIG. 1 shown in a second operating position.

The pump shown in FIGS. 1 and 2 consists of a housing 10 which incorporates an elongate chamber 12 and a transverse through chamber 14 for the passage of pumped liquid. The through chamber 14 has an inlet 16 and an outlet 18, between which are two parallel channels 20,22 which can be opened and closed by means of valves 24*a*,24*b*,24*c* and 24*d*. The channels 20,22 are variable in volume in their central sections by means of the movement of pistons 26,28 which are rigidly connected by connecting member 30. Seals 32*a* and 32*b* form liquid-tight connections between the pistons 26,28 and the interior wall of the chamber 12.

Pistons 26 and 28 are arranged so as to be reciprocatingly movable within the chamber 12. The movement takes place along the longitudinal axis of chamber 12 and is controlled by means not shown in detail in the accompanying drawings. Furthermore, gas introduction means 34 are provided to allow the introduction of compressed gas into the chamber either to the left of piston 26 or to the right of piston 28 as desired. Venting means 36 allowing venting of these portions of the piston 12 are also provided.

The apparatus described thus far is known. However, the venting means 36 are attached to pressure regulating means in the form of a pressure valve 40. The pressure valve 40 incorporates control means and/or sensing means designed to detect the pressure of the liquid within the channels 20,22 or at the inlet 16 and to allow the portions of the chamber 12 to the left of piston 26 and to the right of piston 28 from being vented to a pressure substantially different from the pressure in the channels 20,22. This prevents undue pressure differences occurring across the seals 32*a*,32*b*.

The operation of the pump shown in FIGS. 1 and 2 will now be described. In the position shown in FIG. 1, piston 26,28 have just completed a stroke from right to left. Valve 24*a* is closed and valve 24*b* is open having just allowed the liquid to be pumped to enter channel 20 from the inlet 16. Valve 24*c* is open and valve 24*d* is closed and the movement of piston 28 from right to left has just forced the majority of the fluid in the channel 22 through valve 24*c* to outlet 18. The pressure in channels 20,22 corresponds to the internal pressure of the liquid being pumped, e.g. 18–28 psi. The pressure in the portion of the chamber 12 to the right of piston 28 is approximately 60 psi, this being the pressure of $CO_2$ or other suitable gas used to move the piston 26,28 from right to left. The pressure in the chamber to the left of piston 26 is substantially lower to allow the movement to have taken place.

At the completion of the stroke described above, each of the valves 24*a*,24*b*,24*c*,24*d* alters its position. Valve 24*a* opens, valve 24*b* closes, valve 24*c* closes and valve 24*d* opens. Compressed $CO_2$ or other suitable gas at a pressure of around 60 psi is introduced into the chamber to the left of piston 26 and a return stroke from left to right of piston 26 and 28 is initiated. However, instead of the portion of the chamber 12 to the right of piston 28 being vented to atmospheric pressure, the pressure regulator 40 comes into operation and allows that portion of the chamber to be vented only to a pressure of substantially the same as that pressure exerted on the seal 32*b* by the fluid in the channel 22. This means that the pressure difference across the seal 32*b* is relatively small. Damage to the seal and/or distortion of the seal 32*b* is thereby minimised.

When the portion of the chamber 12 to the right of piston 28 has been vented to a suitable level, pistons 26, 28 will move from left to right to the position shown in FIG. 2. Because of the position of the seals 24*a*,24*b*, fluid previously contained in the channel 20 will be forced through the outlet 18 by the movement of the piston 26. Similarly, because of the position of valves 24*c*,24*d*, fluid will be drawn into channel 22 by the movement of the piston 28.

At the completion of this stroke, the position of each valve again reverses and compressed carbon dioxide or other suitable gas is then introduced into the chamber 12 to the right of the piston 28 via the compressed gas supply means 34. The chamber 12 to the left of piston 26 will be vented through the venting means 36 but, as before, the extent of the venting will be regulated by the pressure regulator 40. Again, the pressure difference across the seal 32*a* will be minimised.

The reduction of the pressure difference across the seals 32*a*,32*b* means that any damage to or distortion of the seals is kept to a minimum. The working life of the seals is thereby increased and maintenance costs relating to the pump are minimised.

The pressure regulator 40 can take any suitable form. It can be arranged to be preset in accordance with the known internal pressure of a fluid to be pumped by the pump. Alternatively, the pump can be provided with pressure sensors (not shown) inside the channels 20,22 or in the vicinity of the inlet 16 or outlet 18 to detect the internal pressure of the pumped fluid. In this way, the pressure to which the relevant portion of the chamber 12 is vented can be regulated in accordance with the internal pressure of the pumped fluid.

Figure 3:
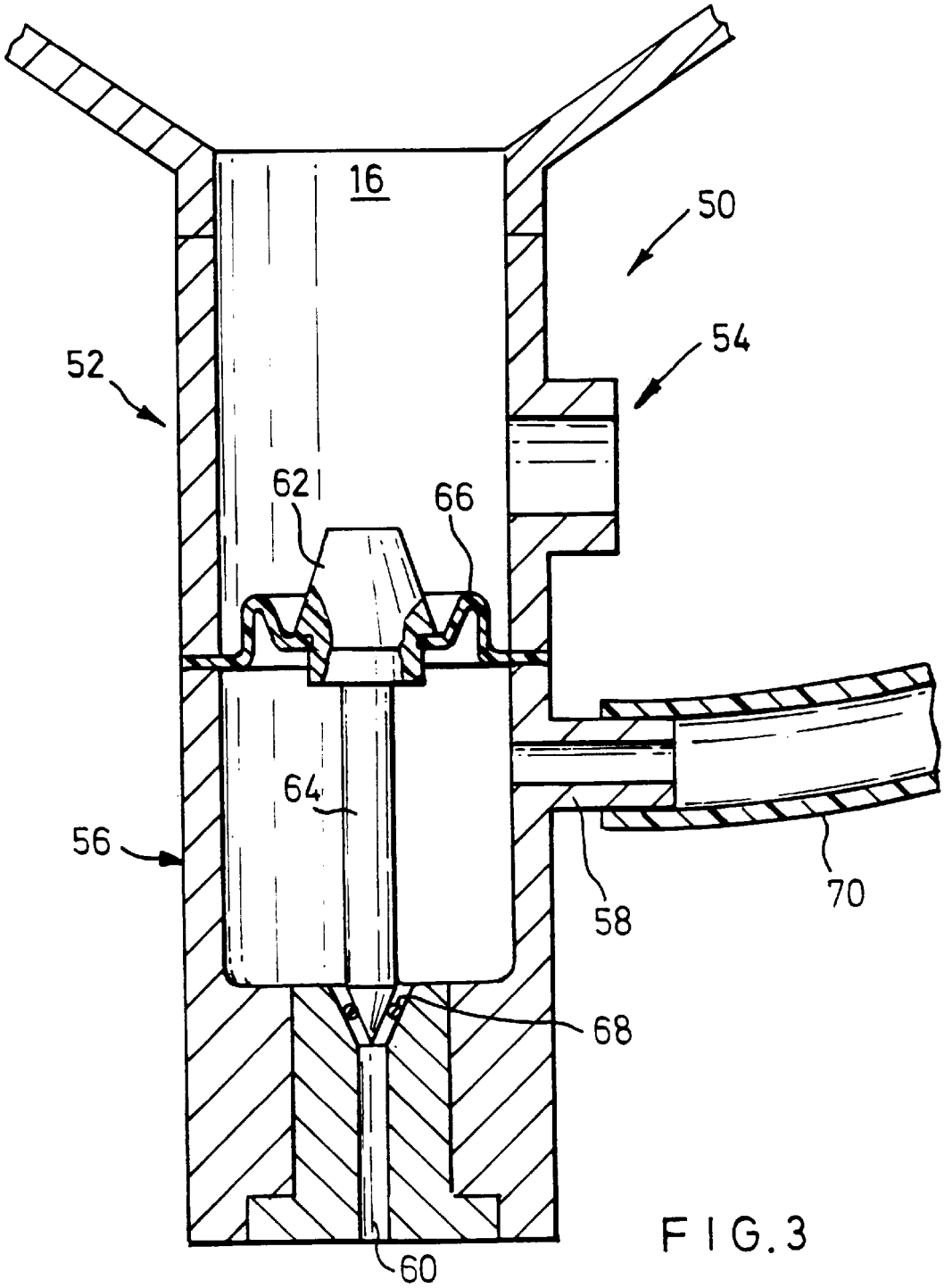
FIG. 3 is an enlarged cross sectional detail of part of a pump according to a second embodiment of the invention.

However, FIG. 3 illustrates a regulator 50 which forms part of a preferred embodiment of a pump according to the invention. The regulator 50 would replace the regulator 40 shown in FIGS. 1 and 2 and can be used in conjunction with a pump having all of the remaining features of the pump shown in FIGS. 1 and 2. The regulator 50 comprises an upper portion 52 which can be arranged to be connected to the inlet 16 of the pump. If desired, the upper portion 52 can be formed integrally with the inlet 16 or can be connected thereto by suitable connecting means (not shown). The upper portion 52 includes a fluid inlet 54 which is intended to be connected to a supply or reservoir of fluid to be pumped by the pump. The regulator 50 also comprises a lower portion 56 which includes an exhaust gas inlet 58 and an exhaust gas outlet 60.

Between the upper and lower portions 52,56 is located a movable shut-off valve 62 comprising a central pin 64 and a flexible diaphragm 66. The diaphragm 66 is fixedly connected to the wall of the regulator 50 and to the central pin 64. The central pin 64 extends downwardly from the diaphragm 66 towards the exhaust gas outlet 60 and, in the position shown in FIG. 3, the end of the central pin 64 rests in the entrance to the exhaust gas outlet 60. An O-ring seal 68 is provided between the central pin 64 and the entrance to the exhaust gas outlet 60 such that, when the end of the pin 64 rests in the outlet 60, a gastight seal is produced. However, when an upward force is exerted on the shut-off valve 62, the valve 62 can move upwardly so that the central pin 64 moves out of engagement with the entrance to the exhaust gas outlet 60 and thus the gastight seal provided by the O-ring seal 68 is broken. Any upward movement of the shut-off valve 62 is limited by the diaphragm 66.

The operation of the regulator 50 is as follows. Fluid to be pumped by the pump is introduced to the inlet 16 via the upper portion 52. Specifically, the supply or reservoir of fluid to be pumped is connected to the fluid inlet 54. The fluid then fills the upper portion 52 of the regulator 50 above the shut-off valve 62. The internal pressure of the fluid to be pumped is therefore exerted on all of the internal surfaces of the upper portion 52, including the upper surface of the diaphragm 66 and the central pin 64. The venting means 36 (see FIGS. 1 and 2) are connected directly to the exhaust gas inlet 58 by means of a pipe 70. Gas which is vented or exhausted from the portion of the chamber 12 either to the left of piston 26 or to the right of piston 28 is thus passed directly to the lower portion 56 of the regulator 50. The pressure of the vented gas is therefore exerted on all of the internal surfaces of the lower portion 56, including the lower surface of the diaphragm 66 and the central pin 64.

When the pressure of the vented gas in the lower portion 56 exceeds the internal pressure of the fluid to be pumped, the shut-off valve 62 is raised thus opening the entrance to the exhaust gas outlet 60. The exhaust or vented gas thus has a free passage out of the regulator 50 via the outlet 60. If, however, the pressure of the exhaust gas drops below the internal pressure of the fluid to be pumped, the shut-off valve 62 will drop to the position shown in FIG. 3, ie. with the lower end of the central pin 64 in engagement with the entrance to the exhaust gas outlet 60. The outlet 60 is thereby sealed thus preventing any further escape of vented gas. Only when the pressure of the exhaust gas again exceeds the internal pressure of the fluid to be pumped will the outlet 60 be re-opened to allow the exhaust gas to escape. The exhaust gas is thereby maintained substantially at the internal pressure of the fluid to be pumped.

It will be appreciated that, if desired, biasing means can be incorporated into the regulator 50 so as to bias the shut-off valve 62 in one direction or another. The effect of this would be to maintain the pressure of the exhaust gas a little above or below the internal pressure of the fluid to be pumped depending upon whether the biasing were downward or upward.

It is envisaged that a pump of the type indicated above can be included in a pumping system suitable for use in any situation such as, e.g. a brewery or public house or any other industrial situation. When the system is intended for use in pumping beverages, the pump will be designed to handle liquids having internal pressures of between 7 and 30 psi although liquids having higher internal pressures can preferably be handled. The pumping system will incorporate known means for connecting the inlet 16 of the pump to a reservoir of a liquid, e.g. beer or other beverage, and the outlet 18 of the pump will be connected to a conventional dispenser. It is envisaged that a pumping system of this type could incorporate a plurality of pumps as described above and these pumps could be connected to individual dispensers if desired. If a plurality of pumps is provided, they could be supplied by a single reservoir or from separate reservoirs of liquid.

It will be appreciated that the invention is not limited to the embodiments described above but encompasses any and all variations which will be apparent to a reader skilled in the art.

I claim:

1. A pump comprising:

a chamber having an inlet and an outlet, the inlet and the outlet being opened and closed by valve means for the passage of a pumped fluid;

at least one piston movable in a reciprocating manner within said chamber;

sealing means located between the piston and the interior wall of the chamber;

introduction means for introducing a working fluid into a portion of the chamber bounded by the interior wall of the chamber, the piston and the sealing means; and venting means for venting the portion of the chamber so that alternate introduction of the working fluid into, and venting of the working fluid from, the portion of the chamber causes the piston to move in a reciprocating manner to transport the pumped fluid through the chamber from the inlet to the outlet, wherein the venting means incorporates pressure regulating means to regulate, in dependence upon the pressure of the pumped fluid, the pressure to which the said portion of the chamber is vented such that, in use, the pressure of the working fluid in the said portion of the chamber is prevented from falling, during venting, below the pressure of the pumped fluid in the chamber.

2. A pump as claimed in claim 1, wherein the pressure regulating means comprise sensors for sensing the pressure of the fluid being pumped by the pump and means for controlling the regulated pressure in accordance with the pressure sensed by the sensors.

3. A pump as claimed in claim 1, wherein the regulating means comprise a movable shut-off valve responsive in use to the difference between the pressure within the said portion of the chamber and the pressure of the pumped fluid in the chamber.

4. A pump as claimed in claim 3, wherein the movable shut-off valve is movable between an open position allowing venting of the said portion of the chamber and a closed position preventing venting of the said portion of the chamber, the valve being moved from the open position to the closed position when, in use, the pressure in the said portion of the chamber drops below the pressure of the pumped fluid in the chamber.

5. A pump as claimed in claim 4, wherein the movable shut-off valve comprises a diaphragm exposed, in use, on one side to the fluid being pumped by the pump and on the other side to the vented contents of the said portion of the chamber.

6. A pump as claimed in claim 1, wherein two pistons are located in the chamber.

7. A pump as claimed in claim 1, wherein the sealing means comprise at least one rolling diaphragm seal.

8. A pumping system for pumping a fluid from at least one reservoir to at least one dispensing point, said system comprising at least one pump and attachment means for connecting said at least one pump to said at least one reservoir, said at least one pump comprising:

a chamber having an inlet and an outlet, the inlet and outlet being opened and closed by valve means for the passage of the pumped fluid;

at least one piston movable in a reciprocating manner within said chamber;

sealing means located between the piston and the interior wall of the chamber;

introduction means for introducing a working fluid into a portion of the chamber bounded by the interior wall of the chamber, the piston and the sealing means; and venting means for venting the portion of the chamber so that alternate introduction of the working fluid into, and venting of the working fluid from, the portion of the chamber causes the piston to move in a reciprocating manner to transport the pumped fluid through the chamber from the inlet to the outlet, wherein the venting means incorporates pressure regulating means to regulate, in dependence upon the pressure of the pumped fluid, the pressure to which the said portion of the chamber is vented such that, in use, the pressure of the working fluid in the said portion of the chamber is prevented from falling, during venting, below the pressure of the pumped fluid in the chamber.

9. A pumping system as claimed in claim 8, wherein a plurality of dispensing points are provided and a separate pump is associated with each dispensing point.

10. A method of pumping a fluid using a pump, the pump comprising:

a chamber having an inlet and an outlet, the inlet and outlet being opened and closed by valve means for the passage of the pumped fluid;

at least one piston movable in a reciprocating manner within said chamber;

sealing means located between the piston and the interior wall of the chamber;

introduction means for introducing a working fluid into a portion of the chamber bounded by the interior wall of the chamber, the piston and the sealing means; and venting means for venting the portion of the chamber so that alternate introduction of the working fluid into, and venting of the working fluid from, the portion of the chamber causes the piston to move in a reciprocating manner to transport the pumped fluid through the chamber from the inlet to the outlet, wherein the venting means incorporates pressure regulating means to regulate, in dependence upon the pressure of the pumped fluid, the pressure to which the said portion of the chamber is vented such that, in use, the pressure of the working fluid in the said portion of the chamber is prevented from falling, during venting, below the pressure of the pumped fluid in the chamber, the method comprising the steps of causing said at least one piston to move within the chamber, and venting said portion of the chamber, wherein the venting is regulated, in dependence upon the pressure of the pumped fluid, so as to maintain the pressure in the said portion of the chamber substantially at the pressure acting on the sealing means on the side thereof remote from the said portion of the chamber.

11. A method as claimed in claim 10, wherein carbon dioxide gas is used to cause reciprocating movement of said piston within said portion of the chamber.

* * * * *